US008805259B2

(12) United States Patent
Fujiwara et al.

(10) Patent No.: US 8,805,259 B2
(45) Date of Patent: Aug. 12, 2014

(54) FIXING DEVICE AND IMAGE FORMING APPARATUS

(75) Inventors: Takashi Fujiwara, Hachioji (JP); Shoichi Yoshikawa, Okazaki (JP); Tadayasu Sekioka, Toyohashi (JP); Noboru Oomoto, Toyokawa (JP); Yoshiyuki Toso, Toyokawa (JP); Naoki Miyagawa, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 194 days.

(21) Appl. No.: 13/608,771

(22) Filed: Sep. 10, 2012

(65) Prior Publication Data

US 2013/0071152 A1 Mar. 21, 2013

(30) Foreign Application Priority Data

Sep. 20, 2011 (JP) ..... 2011-204484

(51) Int. Cl.
*G03G 15/20* (2006.01)
*G03G 21/16* (2006.01)

(52) U.S. Cl.
CPC ..... *G03G 15/2092* (2013.01); *G03G 21/1685* (2013.01)
USPC ..... 399/329; 399/69; 399/122

(58) Field of Classification Search
USPC ..... 399/67, 69, 107, 110, 122, 320, 328, 399/329
See application file for complete search history.

(56) References Cited

U.S. PATENT DOCUMENTS 8,554,097 B2 * 10/2013 Hara et al. ..... 399/69

FOREIGN PATENT DOCUMENTS

| | | |
|---|---|---|
| JP | 2007-3599 | 1/2007 |
| JP | 2007-25349 | 2/2007 |
| JP | 2008-096752 | 4/2008 |
| JP | 2010-66552 | 3/2010 |

OTHER PUBLICATIONS

Decision to Grant Patent mailed Oct. 1, 2013, directed to JP Application No. 2011-204484; 4 pages.

* cited by examiner

*Primary Examiner* — Hoan Tran
(74) *Attorney, Agent, or Firm* — Lucas & Mercanti, LLP

(57) ABSTRACT

A fixing device includes a heating rotating body driven by a motor, a pressing member, a biasing unit, a switching unit that receives rotational power of the motor in order to either separate the pressing member and the heating rotating body or to allow the biasing unit to press the pressing member and the heating rotating body together, a power transmission mechanism that transmits the rotational power of the motor to the switching unit over a first path or a second path, the first path having a larger reduction ratio, and a power transmission targeting unit that switches the target of transmission of rotational power of the motor between the heating rotating body and the switching unit depending on the rotational direction of the motor and that includes a path selection unit that selects the first path during separation and the second path during pressing by the switching unit.

6 Claims, 10 Drawing Sheets

FIXING DEVICE AND IMAGE FORMING APPARATUS

This application is based on application No. 2011-204484 filed in Japan, the contents of which are hereby incorporated by reference.

BACKGROUND OF THE INVENTION (1) Field of the Invention

The present invention relates to a fixing device and an image forming apparatus, and in particular to a fixing device and an image forming apparatus provided with the fixing device that have a structure allowing for switching of a pressing member between a pressing state and a separated state with respect to a heating rotating body of a fixing roller or the like.

(2) Description of the Related Art

In image forming apparatuses such as printers, a fixing device that uses a heat fixing method fixes toner to a recording sheet in the following way. For example, a pressing roller, which acts as a pressing member, is pressed against the circumferential surface of a rotating fixing roller by the restorative force of an elastic member such as a compression spring, thereby forming a fixing nip. A recording sheet carrying a toner image is passed through this fixing nip in order to fix the toner image to the recording sheet.

The outermost surface of the pressing roller is typically an elastic layer formed from silicone rubber or fluorinated resin. A portion of the elastic layer elastically deforms in order to form the fixing nip. As a result, if the pressing roller is continually pressed against the fixing roller, the portion of the elastic layer that elastically deforms may not fully return to its original shape if a long time passes without any images being formed. Such a change in shape would prevent smooth transport of recording sheets.

One way of addressing this problem is to provide a switching mechanism (a switching unit) that switches the pressing roller and the fixing roller between a separation state, in which the pressing roller and the fixing roller are not in contact, and a pressing state in which the pressing roller presses against the fixing roller. The switching mechanism places the pressing roller and the fixing roller in the separation state by resisting the restorative force of the elastic member during any time other than image formation (fixing) and places the pressing roller and the fixing roller in the pressing state by allowing the restorative force to act during image formation.

The switching mechanism may, for example, include a plate cam and operate by receiving the rotational force of a motor transmitted over a power transmission mechanism that includes a gear train or the like. The circumferential surface of the plate cam abuts a frame or the like that supports the pressing roller. As the plate cam rotates, the pressing roller is separated from the fixing roller, against the restorative force of the elastic member, or is returned to a position so as to press against the fixing roller.

There is a desire to reduce the cost of all manufactured goods, and image forming apparatuses are no exception. In particular, there is a desire to reduce the cost of the fixing device, which is relatively high as compared to other components of an image forming apparatus.

One approach that has been examined to reduce costs is to reduce the number of motors by one by using the same motor as both the motor for the switching mechanism and the rotary drive motor for the fixing roller. Hereinafter, the motor shared by the fixing roller and the switching mechanism is referred to as a shared motor.

For example, a one-way clutch may be incorporated in the power transmission mechanism between the shared motor and the fixing roller and in the power transmission mechanism between the shared motor and the cam (switching mechanism). The shared motor may then rotate in the normal direction to cause the fixing roller to rotate and the cam to stop rotating, and rotate in the reverse direction to cause the fixing roller to stop rotating and the cam to rotate. Switching the direction of rotation of the shared motor before and after a series of image forming operations allows for rotation of the cam in order to cause the pressing roller to press against the fixing roller or to be separated from the fixing roller.

Such a structure, however, causes the following problems to arise.

When starting image formation, the fixing roller does not rotate until the pressing operation of the pressing roller is complete. Therefore, a longer time is required from when an image formation instruction is issued until the entire fixing roller is evenly heated in order to allow for fixing.

One way of addressing this problem is to lower the reduction ratio in the mechanism for transmitting power from the shared motor to the cam in order to rotate the cam quickly. The pressing operation of the pressing roller will thus be completed quickly, shorting the time until the start of rotation of the fixing roller. Reducing the reduction ratio, however, causes an increase in the load (torque) on the shared motor upon separation of the pressing roller (upon compression of the compression spring). As a result, a shared motor with a high torque must be used, which increases the size of the motor, thus increasing the size of the fixing device.

SUMMARY OF THE INVENTION

A fixing device according to one aspect of the present invention is a fixing device comprising: a heating rotating body driven by a motor; a pressing member; a biasing unit configured to place the pressing member and the heating rotating body in a first state by pressing the pressing member and the heating rotating body together with a biasing force so as to form a nip through which a recording sheet with a toner image formed thereon passes; a switching unit configured to receive rotational power of the motor in order to switch the pressing member and the heating rotating body from the first state to a second state, in which the pressing member and the heating rotating body are not in contact, by separating the pressing member and the heating rotating body from each other in resistance to the biasing force of the biasing unit, and to switch the pressing member and the heating rotating body from the second state to the first state by allowing the biasing force of the biasing unit to press the pressing member and the heating rotating body together; a power transmission mechanism configured to transmit the rotational power of the motor to the switching unit; and a power transmission targeting unit configured to switch a target of the transmission of the rotational power of the motor between the heating rotating body and the switching unit in accordance with whether the motor rotates in a normal direction or a reverse direction, wherein the power transmission mechanism uses one of a first transmission path and a second transmission path for the transmission of rotational power, a reduction ratio of the first transmission path being larger than a reduction ratio of the second transmission path, and the power transmission targeting unit includes a path selection unit configured to select the first transmission path when the switching unit switches the pressing member and the heating rotating body from the first state to the second state and to select the second transmission path when the switching unit switches the pressing member and the heating rotating body from the second state to the first state.

An image forming device to another aspect of the present invention is an image forming apparatus that forms an image on a recording sheet by electrophotography and includes a fixing device that fixes a toner image to a recording sheet on which the toner image is formed, the fixing device comprising: a heating rotating body driven by a motor; a pressing member; a biasing unit configured to place the pressing member and the heating rotating body in a first state by pressing the pressing member and the heating rotating body together with a biasing force so as to form a nip through which a recording sheet with a toner image formed thereon passes; a switching unit configured to receive rotational power of the motor in order to switch the pressing member and the heating rotating body from the first state to a second state, in which the pressing member and the heating rotating body are not in contact, by separating the pressing member and the heating rotating body from each other in resistance to the biasing force of the biasing unit, and to switch the pressing member and the heating rotating body from the second state to the first state by allowing the biasing force of the biasing unit to press the pressing member and the heating rotating body together; a power transmission mechanism configured to transmit the rotational power of the motor to the switching unit; and a power transmission targeting unit configured to switch a target of the transmission of the rotational power of the motor between the heating rotating body and the switching unit in accordance with whether the motor rotates in a normal direction or a reverse direction, wherein the power transmission mechanism uses one of a first transmission path and a second transmission path for the transmission of rotational power, a reduction ratio of the first transmission path being larger than a reduction ratio of the second transmission path, and the power transmission targeting unit includes a path selection unit configured to select the first transmission path when the switching unit switches the pressing member and the heating rotating body from the first state to the second state and to select the second transmission path when the switching unit switches the pressing member and the heating rotating body from the second state to the first state.

BRIEF DESCRIPTION OF THE DRAWINGS

These and the other objects, advantages and features of the invention will become apparent from the following description thereof taken in conjunction with the accompanying drawings which illustrate specific embodiments of the invention.

In the drawings.

DESCRIPTION OF THE PREFERRED EMBODIMENTS

With reference to the drawings, the following describes a fixing device, and an image forming apparatus provided with the fixing device, according to aspects of the present invention.

Embodiment 1

Figure 1:
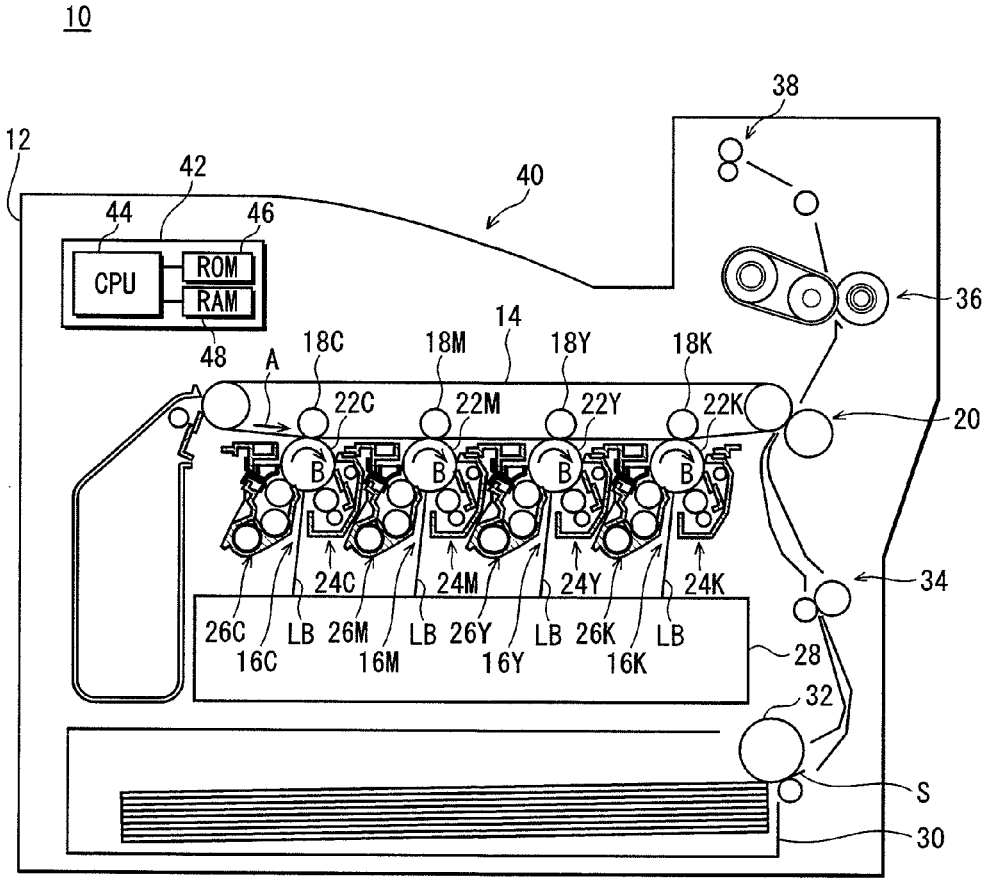
FIG. 1 illustrates the structure of a tandem-type printer according to Embodiment 1.

FIG. 1 illustrates the structure of a tandem-type printer 10 (hereinafter simply referred to as a "printer 10") according to Embodiment 1. While the example of a printer is described here, the present invention is also applicable to other image forming apparatuses such as copiers, facsimile machines, and so forth.

The printer 10 is an image forming apparatus that adopts the so-called intermediate transfer method. As shown in FIG. 1, the printer 10 includes a transfer belt 14 that is provided horizontally within a housing 12 and that moves in the direction of the arrow A; four imaging units 16C, 16M, 16Y, and 16K provided in series along the direction of movement of the transfer belt 14; primary transfer rollers 18C, 18M, 18Y, and 18K that correspond to the imaging units; and a secondary transfer unit 20. Toner images of various colors formed by the imaging units 16C, 16M, 16Y, and 16K are overlaid on the transfer belt 14 and then transferred to a recording sheet S to form a color image.

The central components of the four imaging units 16C, 16M, 16Y, and 16K are respective photoconductive drums 22C, 22M, 22Y, and 22K that act as image carriers. The imaging units 16C, . . . , 16K also include respective charging units 24C, 24M, 24Y, and 24K provided by the respective photoconductive drums 22C, . . . , 22K and respective developing units 26C, 26M, 26Y, and 26K. An exposure unit 28 is provided below the imaging units 16C, . . . , 16K and emits optically modulated laser beams LB towards the photoconductive drums 22C, . . . , 22K. The surfaces of the photoconductive drums 22C, . . . , 22K, which rotate in the direction of the arrow B, are charged uniformly by the charging units 24C, . . . , 24K and exposed to the laser beams LB to form electrostatic latent images thereon. The electrostatic latent images are developed as toner images by the developing units 26C, . . . , 26K. Note that the developing units 16C, . . . , 16K correspond to the color component of the optically modulated laser light in order to provide the photoconductive drums 22C, . . . , 22K with developer in the form of C (cyan), M (magenta), Y (yellow), and K (black) toner.

The toner images formed on the photoconductive drums 22C, . . . , 22K are affected by the electrical field produced between the primary transfer rollers 18C, . . . , 18K, and the photoconductive drums 22C, . . . , 22K so as to be transferred successively to the moving transfer belt 14.

A recording sheet S is picked up from a paper cassette 30 by a pickup roller 32 and is transported by a pair of resist rollers 34 so as to arrive at the secondary transfer unit 20 at the same time as the toner images on the transfer belt 14. The secondary transfer unit 20 transfers the toner images that have been overlaid on one another on the transfer belt 14 to the recording sheet.

The toner images on the recording sheet S are fixed by a fixing device 36, and the recording sheet S is then ejected into a discharge tray 40 by a pair of discharge rollers 38.

The printer 10 also includes a controller 42. The controller 42 includes a CPU 44 connected to a ROM 46 and a RAM 48. The CPU 44 executes control programs stored in the ROM 46 to perform smooth image forming operations through comprehensive control of the above-described units and devices.

Figure 2:
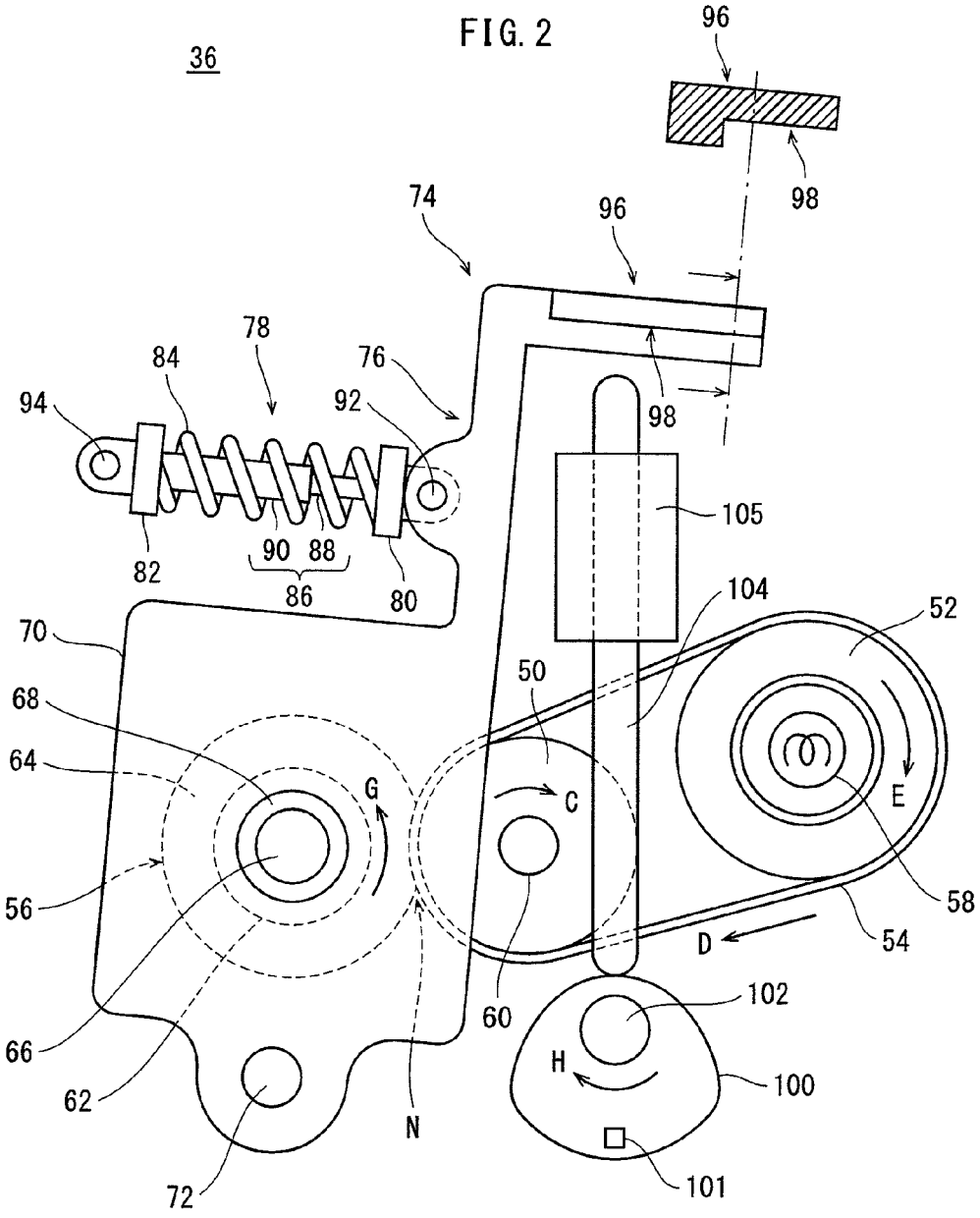
FIG. 2 is a front view of a portion of the fixing device according to Embodiment 1, illustrating a state in which the pressing roller is pressed against the fixing belt.

FIG. 2 is a front view of a portion of the structure of the fixing device 36.

The fixing device 36 adopts a thermal belt fixing method and includes a fixing roller 50, a heat roller 52, a fixing belt 54 stretched between the fixing roller 50 and the heat roller 52, and a pressing roller 56.

The heat roller 52 is formed from a metal tube member. A heater lamp 58 is provided as a heat source inside the hollow portion of the tube member. Both edges of both the fixing roller 50 and the heat roller 52 are rotatably supported via bearings by a support member (neither the bearings nor the support member being shown in the figures).

A spur gear 126 (shown in FIG. 4, not in FIG. 2), described below, is attached to a metal core 60 of the fixing roller 50 and is rotated in the direction shown by the arrow C with a motor 106 (FIG. 5) as the source of rotational force. The fixing belt 54 thus rotates in the direction shown by the arrow D, thereby causing the heat roller 52 to rotate in the direction shown by the arrow E.

The pressing roller 56 is formed by a metal core 62 with an elastic layer 64 formed from silicone rubber or fluorinated resin on the outer circumferential surface thereof. The metal core 62 has an overall cylindrical shape. The elastic layer 64 is formed at a central region of the metal core 62, and at both ends of the central region, the metal core 62 has reduced diameter portions 66 with a smaller diameter than the central region. One reduced diameter portion 66 of the pressing roller 56 is axially supported, via a bearing 68, by a swing plate 70 that is a support member of the pressing roller 56.

The swing plate 70 is a metal plate. The thickness of the swing plate 70 is uniform in a direction perpendicular to the plane of FIG. 2. The swing plate 70 is attached to a shaft 72, whose direction of length is perpendicular to the plane of FIG. 2, and can swing about the central axis of the shaft 72. The shaft 72 is fixed to a housing not shown in the figures.

The swing plate 70 includes an L-shaped lever 74 at the opposite side of the shaft 72 from the bearing 68.

One end of a spring unit 78 is attached to a first straight portion 76 of the lever 72. The spring unit 78 includes a pair of holders 80 and 82 disposed opposite each other and a compression coil spring 84 (hereinafter referred to as a "compression spring 84") between the holders 80 and 82. The compression spring 84 is an elastic member and acts as a biasing unit. The holders 80 and 82 are connected by a linear guide mechanism 86 that linearly guides both of the holders 80 and 82. The linear guide mechanism 86 is composed of a piston 88 and a cylinder 90.

The holder 80 is attached to the first straight portion 76 by a pin 92. The holder 80 is attached so as to rotate freely about the central axis of the pin 92 with respect to the first straight portion 76 (swing plate 70).

The holder 82 at the other end of the spring unit 78 is attached to a pin 94 whose direction of length is perpendicular to the plane of FIG. 2. The holder 82 rotates freely about the central axis of the pin 94. The pin 94 is fixed to a housing not shown in the figures.

The upper half of a second straight portion 96 of the lever 74 extends out from the plane of FIG. 2 at approximately a right angle, as illustrated by the local cross-section diagram in FIG. 2. The bottom surface of this extended portion forms a contact surface 98 for the tip of a bar 104 that is described below.

Note that the end of the pressing roller 56 towards the back of FIG. 2 is supported axially, via a bearing (not shown in the figures), by a swing plate (not shown in the figures) that, other than not having a lever 74, is similar to the swing plate 70.

FIG. 2 shows the compression spring 84, which is a biasing unit, pressing against the swing plate 70 (first straight portion 76) due to the restorative force of the compression spring 84, the restorative force thus acting as a biasing force. The restorative force acts on the pressing roller 56 attached to the swing plate 70 to press the pressing roller 56 into contact with the fixing roller 50. The elastic layer 64 of the pressing roller 56 elastically deforms, thus forming the fixing nip N. During image formation (during fixing operations), the pressing roller 56 is thus pressed into contact with the fixing roller 50 (with the fixing belt 54 therebetween). The pressing roller 56 is thus caused to rotate in the direction of the arrow G.

In this way, the pressing roller 56 is pressed against the fixing belt 54 during image forming operations, as shown in FIG. 2. When image forming operations are not being performed, the pressing roller 56 is separated from the fixing belt 54. If the pressing roller 56 is continually pressed against the fixing belt 54, the portion of the elastic layer that elastically deforms may not fully return to its original shape if a long time passes without any images being formed. Such a change in shape would prevent smooth transport of recording sheets.

Next, a mechanism for separating the pressing roller 56 from the fixing belt 54 is described.

A plate cam 100, which is an eccentric member, is provided below the contact surface 98 of the second straight portion 96 in the swing plate 70. The plate cam 100 is attached to a cam shaft 102 whose direction of length is perpendicular to the plane of FIG. 2. The cam shaft 102 is rotated in the direction of the arrow H by a motor 106, described below, via a power transmission mechanism, also described below. The plate cam 100 is integrally formed with the cam shaft 102 and therefore also rotates about the central axis of the cam shaft 102.

The bar 104 has a circular cross-section and is supported above the plate cam 100 by a linear bearing 105 so as to slide up and down freely. The bar 104 lowers due to its own weight, and the bottom of the bar 104 is continually in contact with the circumferential surface of the plate cam 100. The linear bearing 105 is attached to a housing not shown in the figures.

In the above structure, when the plate cam 100 is rotated from a state in which the rotational position of the plate cam 100 is at lower dead center, as illustrated in FIG. 2, the bottom of the bar 104 follows the outer circumferential surface of the plate cam 100, causing the bar 104 to slide upwards and the top of the bar 104 to come into contact with the contact surface 98. Further rotation of the plate cam 100 causes the bar 104 to push the contact surface 98 upwards and act against the restorative force of the compression spring 84 so that the swing plate 70 rotates counter-clockwise around the central axis of the shaft 72.

Figure 3:
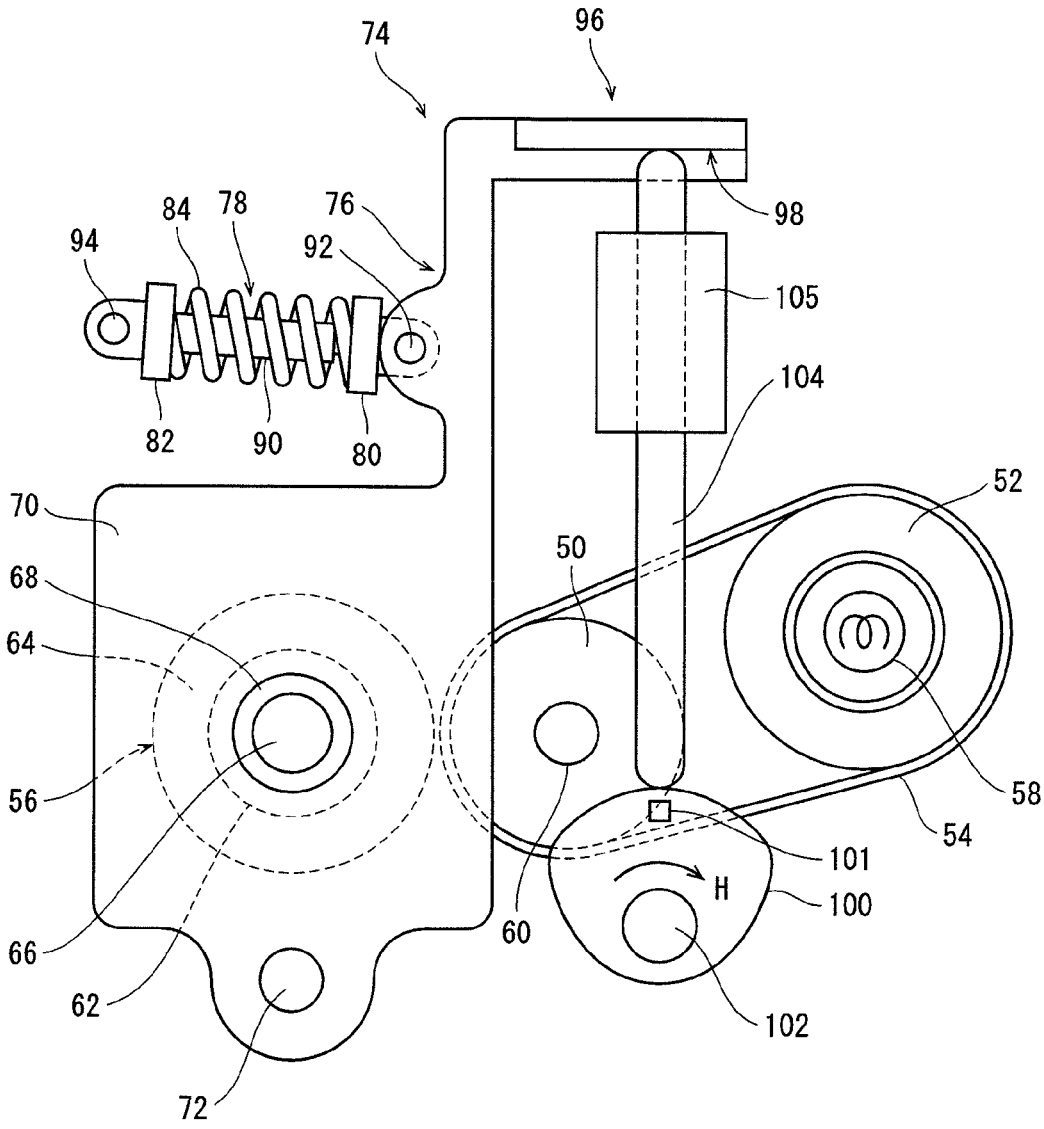
FIG. 3 is a front view of a portion of the fixing device according to Embodiment 1, illustrating a state in which the pressing roller is separated from the fixing belt.

As shown in FIG. 3, when the rotational position of the plate cam 100 is at upper dead center, the swing plate 70 is rotated a maximum amount toward the left, causing the pressing roller 56 to separate from the fixing roller 50. In this state, the compression spring 84 is in a maximum state of compression and thus has a maximum stored amount of elastic energy.

A reflecting seal 101 is adhered to the side of the plate cam 100 near a position farthest from the central axis of the cam shaft 102. The reflecting seal 101 is for detecting whether the plate cam 100 is at upper dead center or lower dead center. A lower dead center sensor 162 (not shown in FIG. 2 or 3) is provided for detecting the reflecting seal 101 when the plate cam 100 is at lower dead center, as illustrated in FIG. 2, and an upper dead center sensor 164 (not shown in FIG. 2 or 3) is provided for detecting the reflecting seal 101 when the plate cam 100 is at upper dead center, as illustrated in FIG. 3 (see FIG. 6). A reflective photo sensor is used for the lower dead center sensor 162 and the upper dead center sensor 164.

The cam shaft 102, the plate cam 100, the bar 104, the linear bearing 105, the swing plate 70, the shaft 72, and the bearing 68 thus constitute a switching unit that causes the pressing roller 56 and the fixing belt 54 to come into contact or to separate, thereby changing between a separated state (FIG. 3) when the pressing roller 56 and the fixing belt 54 are separated and a pressing state (FIG. 2) when the pressing roller 56 is acted on by the restorative force of the compression spring 84 and thus caused to press against the fixing belt 54.

Next, the structure for causing the fixing roller 50 and the fixing belt 54 to rotate, as well as the structure for causing the plate cam 100 (the cam shaft 102) to rotate, are described with reference to FIGS. 4 and 5.

Figure 4:
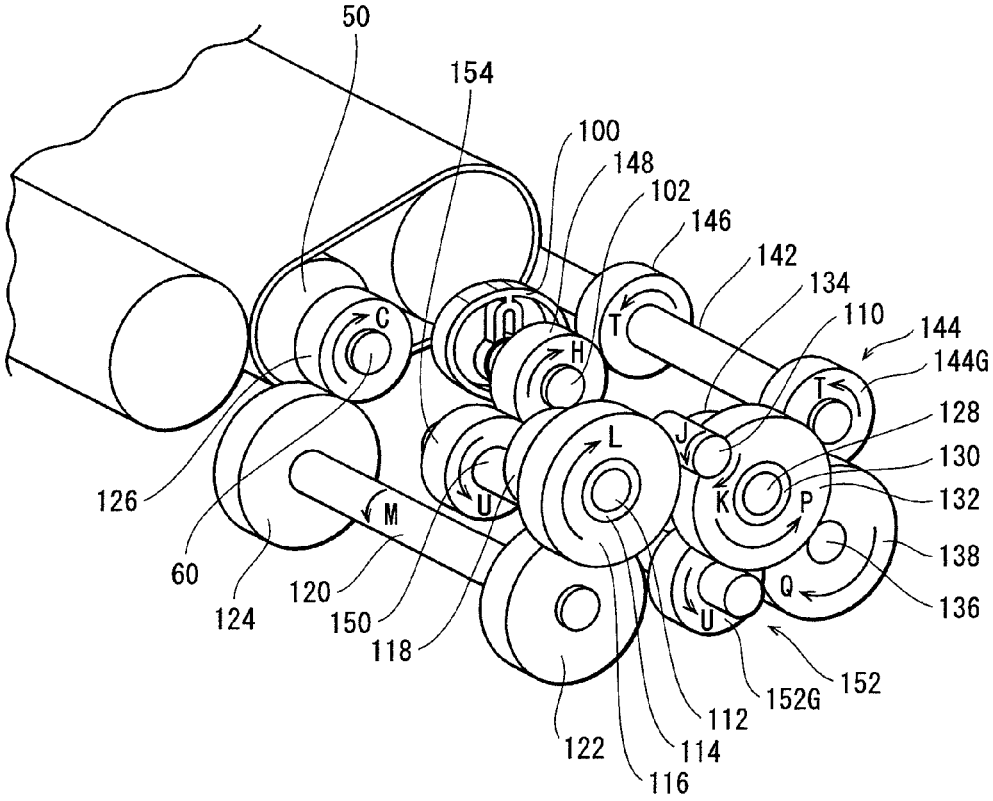
FIG. 4 is a perspective view of the fixing device according to Embodiment 1, illustrating a portion of the structure of a mechanism for transmitting power from a motor to a fixing roller and a plate cam.

FIG. 4 is a perspective view illustrating the structure of a mechanism for transmitting power from the motor 106 (not shown in FIG. 4; see FIG. 5) to the fixing roller 50 and a mechanism for transmitting power from the motor 106 to the plate cam 100 (the cam shaft 102). FIG. 5 illustrates power transmission paths in the above two power transmission mechanisms.

Figure 5:
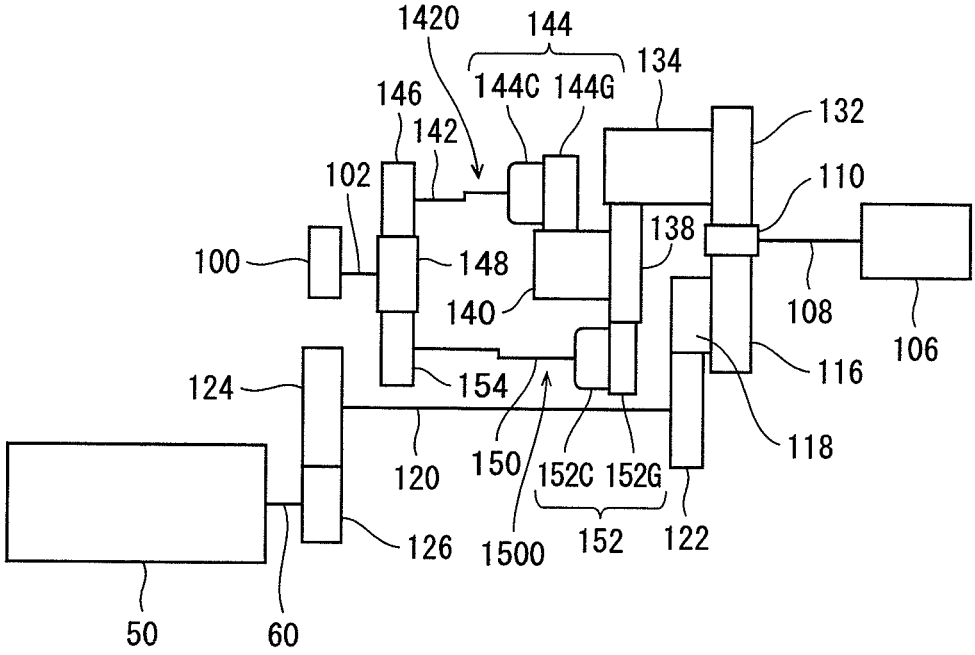
FIG. 5 illustrates power transmission paths in the power transmission mechanism.

Note that the teeth of the spur gear or the like in FIG. 4 and FIG. 5 are omitted from the figures for the sake of convenience, with the spur gear being depicted as a cylinder. Furthermore, the clutch portion of a micro electromagnetic clutch with gears (i.e. a micro electromagnetic clutch, hereinafter referred to simply as an "electromagnetic clutch") is omitted from FIG. 4 to avoid an unnecessary degree of complication. In FIG. 5, the shaft (axis) to which gears or the like are attached is represented as a straight line for the sake of convenience.

First, the mechanism for transmitting power from the motor 106 to the fixing roller 50 is described. Note that the motor 106 can rotate both in the normal direction and the reverse direction.

A spur gear 110 is attached to the end of an output shaft 108 of the motor 106. In the two power transmission mechanisms, the spur gear 110 is the gear with the smallest diameter and with the fewest number of teeth.

A shaft 112 is provided parallel to the central axis of the output shaft 108. A spur gear 116 is attached to one end of the shaft 112 with a one-way clutch 114 therebetween. The spur gear 116 is engaged with the spur gear 110. When the motor 106 rotates in the normal direction, the spur gear 110 rotates in the direction of the arrow J, and the spur gear 116 engaged with the spur gear 110 rotates in the direction of the arrow L. The one-way clutch 114 is provided so as to transmit the rotational power of the spur gear 116 to the shaft 112 in this case. Conversely, when the motor 106 rotates in the reverse direction, the spur gear 110 rotates in the direction of the arrow K, and the spur gear 116 rotates in the direction opposite the arrow L. The one-way clutch 114 does not transmit the rotational power of the spur gear 116 to the shaft 112 in this case (i.e. the spur gear 116 rotates idly with respect to the shaft 112). A spur gear 118 is attached to the other end of the shaft 112.

A shaft 120 is provided parallel to the central axis of the shaft 112.

A spur gear 122 is attached to one end of the shaft 120 and is engaged with the spur gear 118.

A spur gear 124 is attached to the other end of the shaft 120, and a spur gear 126 is attached to an end of a metal core 60 of a fixing roller 50. The spur gears 124 and 126 are engaged.

With the structure described thus far, upon normal rotation of the motor 106, the output shaft 108 rotates, and the spur gear 110 rotates in the direction of the arrow J, as shown in FIG. 4, so that the spur gear 116, which is engaged with the spur gear 110, rotates in the direction of the arrow L. Due to the action of the one-way clutch 114, the rotational power of the spur gear 116 is transmitted to the shaft 112, and the spur gear 118 attached to the shaft 112 rotates in the direction of the arrow L.

Upon rotation of the spur gear 118, the spur gear 122, which is engaged with the spur gear 118, rotates in the direction of the arrow M, as do the shaft 120 to which the spur gear 122 is attached and the spur gear 124 attached to the shaft 120. The spur gear 126, which is engaged with the spur gear 124, rotates in the direction of the arrow C, as does the fixing roller 50, since the spur gear 126 is attached to the metal core 60 thereof.

When the motor 106 rotates in the reverse direction, transmission of power between the spur gear 116 and the shaft 112 is cut off due to the effects of the one-way clutch 114. Therefore, the fixing roller 50 does not rotate.

Next, the mechanism for transmitting power from the motor 106 to the plate cam 100 (cam shaft 102) is described.

A shaft 128 is provided parallel to the central axis of the output shaft 108. A spur gear 132 is attached to one end of the shaft 128 with a one-way clutch 130 therebetween. The spur gear 132 is engaged with the spur gear 110. When the motor 106 rotates in the reverse direction, the spur gear 110 rotates in the direction of the arrow K, and the spur gear 132 engaged with the spur gear 110 rotates in the direction of the arrow P. The one-way clutch 130 is provided so as to transmit the rotational power of the spur gear 132 to the shaft 128 in this case. Conversely, when the motor 106 rotates in the normal direction, the spur gear 110 rotates in the direction of the arrow J, and the spur gear 132 rotates in the direction opposite the arrow P. The one-way clutch 130 does not transmit the rotational power of the spur gear 132 to the shaft 128 in this case (i.e. the spur gear 132 rotates idly with respect to the shaft 128). A spur gear 134 is attached to the other end of the shaft 128.

Within the above-described structure, the one-way clutch 114 and the one-way clutch 130 function as a power transmission targeting unit that switches a target of the transmission of the power of the motor 106 between the fixing roller 50 (the fixing belt 54) via the shaft 112 and the plate cam 100 (the cam shaft 102) via the shaft 128 in accordance with whether the motor 106 rotates in the normal direction or the reverse direction.

A shaft 136 is provided parallel to the central axis of the shaft 128. A spur gear 138 and a spur gear 140 are attached in series to the shaft 136. The diameter of the spur gear 138 is larger than the diameter of the spur gear 140, and the number of teeth of the spur gear 138 is greater. The spur gears 138 and 140 are both attached along the same axis (the shaft 136) to form a double gear structure. The spur gear 138 is engaged with the spur gear 134 and receives rotational power from the spur gear 134 so as to rotate in the direction of the arrow Q, thereby causing the spur gear 140 attached along the same axis to also rotate in the direction of the arrow Q.

A shaft 142 is provided parallel to the central axis of the shaft 136. An electromagnetic clutch 144 is attached to one end of the shaft 142. A spur gear 144G of the electromagnetic clutch 144 is engaged with the spur gear 140. Using a clutch 144C, the electromagnetic clutch 144 transmits or blocks power between a spur gear 144G and the shaft 142.

A spur gear 146 is attached to the other end of the shaft 142. The spur gear 146 is engaged with a spur gear 148 attached to the opposite end of the cam shaft 102 than the plate cam 100.

Another shaft 150 is provided parallel to the shaft 142. An electromagnetic clutch 152 is attached to one end of the shaft 150. A spur gear 152G of the electromagnetic clutch 152 is engaged with the spur gear 138. Using a clutch 152C, the electromagnetic clutch 152 transmits or blocks power between a spur gear 152G and the shaft 150.

A spur gear 154 is attached to the other end of the shaft 150. The spur gear 154 is engaged with the spur gear 148 attached to the cam shaft 102.

The spur gears 1526, 154, 1446, and 146 provided at the tips of the shafts 142 and 150 all have the same diameter and number of teeth.

In the above structure, by selectively engaging one of the clutch 152C and the clutch 144C, power from the motor 106 is transmitted across the path of either the shaft 142 or the shaft 150, so that the plate cam 100 rotates.

For example, if the clutch 144C is engaged while the motor 106 is rotating in the reverse direction, power will be transmitted to the shaft 142 by the spur gear 144E which is engaged with the spur gear 140 and rotates in the direction of the arrow T. The spur gear 146 attached to the shaft 142 will also therefore rotate in the direction of the arrow T. The spur gear 148, which is engaged with the spur gear 146, will rotate in the direction of the arrow H, so that the plate cam 100 also rotates in the direction of the arrow H.

If, on the other hand, the clutch 152C is engaged, power will be transmitted to the shaft 150 by the spur gear 152G, which is engaged with the spur gear 138 and rotates in the direction of the arrow U. The spur gear 154 attached to the shaft 150 will also therefore rotate in the direction of the arrow U. The spur gear 148, which is engaged with the spur gear 154, will rotate in the direction of the arrow H, so that the plate cam 100 also rotates in the direction of the arrow H.

As described above, the mechanism for transmitting power from the output shaft 108 of the motor 106 to the cam shaft 102 splits partway through into two power transmission paths.

In the mechanism for transmitting power from the output shaft 108 of the motor 106 to the cam shaft 102, a path in which the clutch 144C is engaged and power is transmitted by the spur gear 140, the spur gear 1440 the shaft 142, and the spur gear 146 is referred to as a first power transmission path 1420, and a path in which the clutch 152C is engaged and power is transmitted by the spur gear 138, the spur gear 152G the shaft 150, and the spur gear 154 is referred to as a second power transmission path 1500.

In the above case, the reduction ratio from the spur gear 110, attached to the output shaft 108 of the motor 106, to the spur gear 148, attached to the cam shaft 102, is smaller in the second power transmission path 1500 than in the first power transmission path 1420, due to a difference in the number of teeth of the spur gear 138 and the spur gear 140.

Therefore, the plate cam 100 rotates faster when rotated via the second power transmission path 1500 than when rotated via the first power transmission path 1420. Conversely, the first power transmission path 1420 allows for rotation of the plate cam 100 with a greater toque than the second power transmission path 1500.

In the mechanism for transmitting power from the output shaft 108 of the motor 106 to the cam shaft 102, let (i) the reduction ratio in the case of the first power transmission path 1420 be Ra1 and the reduction ratio in the case of the second power transmission path 1500 be Ra2, (ii) the rotation speed of the plate cam 100 in the case of the first power transmission path 1420 be Sa1 and the rotation speed of the plate cam 100 in the case of the second power transmission path 1500 be Sa2, assuming the same speed of revolution of the motor 106, and (iii) the torque acting on the cam shaft 102 in the case of the first power transmission path 1420 be Ta1 and the torque acting on the cam shaft 102 in the case of the second power transmission path 1500 be Ta2. The magnitudes of these values compare as follows.

$$Ra1>Ra2,\ Sa1<Sa2,\ Ta1>Ta2$$

In the present embodiment, when the pressing roller 56 is caused to press against the fixing belt 54, i.e. when the plate cam 100 is rotated from upper dead center in FIG. 3 to lower dead center in FIG. 2, the second power transmission path 1500 is used. This is because in this case, it is necessary to rotate the plate cam 100 quickly in order to complete the pressing operation and begin image formation for the first recording sheet rapidly. At the same time, since the compression spring 84 tends to extend, the swing plate 70 hardly bears the load (torque) for rotating the plate cam 100.

Conversely, when the pressing roller 56 is caused to separate from the fixing roller 50, i.e. when the plate cam 100 is rotated from lower dead center in FIG. 2 to upper dead center in FIG. 3, the first power transmission path 1420 is used. This is because in this case, a large torque is necessary to rotate the swing plate 70 against the elastic force of the compression spring 84. At the same time, since the separating operation is performed after a series of image formation operations, it poses no problem for the separating operation to require a relatively longer time.

Figure 6:
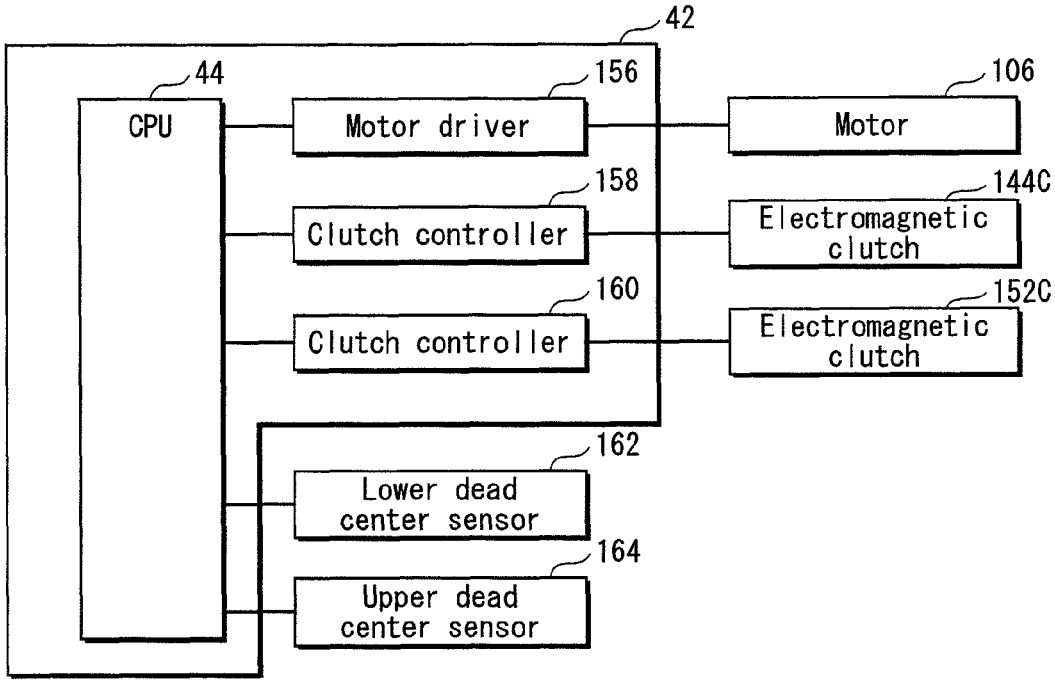
FIG. 6 is a block diagram illustrating a portion of the structure of a controller for the printer, specifically the portion related to controlling rotation of the motor and to controlling rotation of the plate cam.

The CPU 44 of the controller 42 performs rotation control of the plate cam 100 and normal/reverse rotation control of the motor 106. FIG. 6 is a block diagram showing the structure related to both forms of rotation control.

As shown in FIG. 6, the CPU 44 is connected to a motor driver 156 that controls normal/reverse driving of the motor 106 (FIG. 5), a clutch controller 158 that engages and disengages the electromagnetic clutch 144C (FIG. 5), a clutch controller 160 that engages and disengages the electromagnetic clutch 152C (FIG. 5), the lower dead center sensor 162, and the upper dead center sensor 164.

The control program that the CPU 44 executes to control the motor and clutches is described with reference to the flowchart in FIG. 7. Note that before the program runs, the motor 106 is stopped, and the electromagnetic clutches 132C and 124C are both disengaged. Furthermore, the plate cam 100 is at upper dead center.

When a print job is received from an external device and print processing (image formation processing) begins (step S11: YES), the CPU 44 starts rotating the motor 106 in the reverse direction (step S12) and engages the electromagnetic clutch 152C (step S13). As a result, the plate cam 100 rotates via the second power transmission path 1500. As described above, the pressing operation to press the pressing roller 56 against the fixing roller 50 thus begins.

As long as the lower dead center sensor 162 does not turn on (step S14: NO), the electromagnetic clutch 152C stays engaged so as to rotate the plate cam 100. When the lower dead center sensor 162 detects the reflecting seal 101 and turns on (step S14: YES), the pressing operation to press the pressing roller 56 against the fixing roller 50 is considered to be complete. The CPU 44 therefore disengages the electromagnetic clutch 152C (step S5) to stop rotating the plate cam 100 and switches the motor 106 to rotation in the normal direction (step S16). As a result, the fixing roller 50 rotates.

During printing, i.e. during image formation (step S17: NO), the CPU 44 maintains the current conditions, namely operation of the motor 106 and disengagement of the electromagnetic clutches 152C and 144C. Once the print operations are complete (step S17: YES), the CPU 44 switches the motor 106 to rotation in the reverse direction (step S18) and engages the electromagnetic clutch 144C. As a result, the plate cam 100 rotates via the first power transmission path 1420. The separating operation to separate the pressing roller 56 from the fixing roller 50 thus begins.

As long as the upper dead center sensor 164 does not turn on (step S20: NO), the electromagnetic clutch 144C stays engaged so as to rotate the plate cam 100. When the upper dead center sensor 164 detects the reflecting seal 101 and turns on (step S20: YES), the separating operation to separate the pressing roller 56 from the fixing roller 50 is considered to be complete. The CPU 44 therefore disengages the electromagnetic clutch 144C (step S21) to stop rotating the plate cam 100. The CPU 44 then stops the motor 106 (step S22), and the program terminates.

With the above structure, the fixing device 36 of Embodiment 1 achieves both rotation of the fixing roller 50 and pressing/separation of the pressing roller 56 and the fixing belt 54 with a single motor 106. Moreover, while pressing the pressing roller 56 against the fixing belt 54, the plate cam 100 (cam shaft 102) is rotated via the second power transmission path 1500, which has a lower reduction ratio, thereby shortening the time until completion of the pressing operation. Conversely, when separating the pressing roller 56 from the fixing belt 54, the plate cam 100 is rotated via the first power transmission path 1420, which has a higher reduction ratio, in order to achieve the torque necessary to compress the compression spring 84 (i.e. to store elastic energy). This selective use of power transmission paths prevents the motor from becoming unnecessarily large.

Embodiment 2

In Embodiment 1, two electromagnetic clutches 144C and 152C are used in the mechanism for transmitting power from the motor 106 to the plate cam 100 (cam shaft 102). By contrast, in Embodiment 2, no electromagnetic clutches are used in the power transmission mechanism.

The fixing device of Embodiment 2 has a substantially similar structure to the fixing device 36 of Embodiment 1, except for the difference in the structure of the mechanism for transmitting power from the motor 106 to the cam shaft 102. Accordingly, similar portions are labeled with the same numbers as in Embodiment 1, and a description thereof is either omitted or simplified. The following focuses mainly on the differences.

Figure 8:
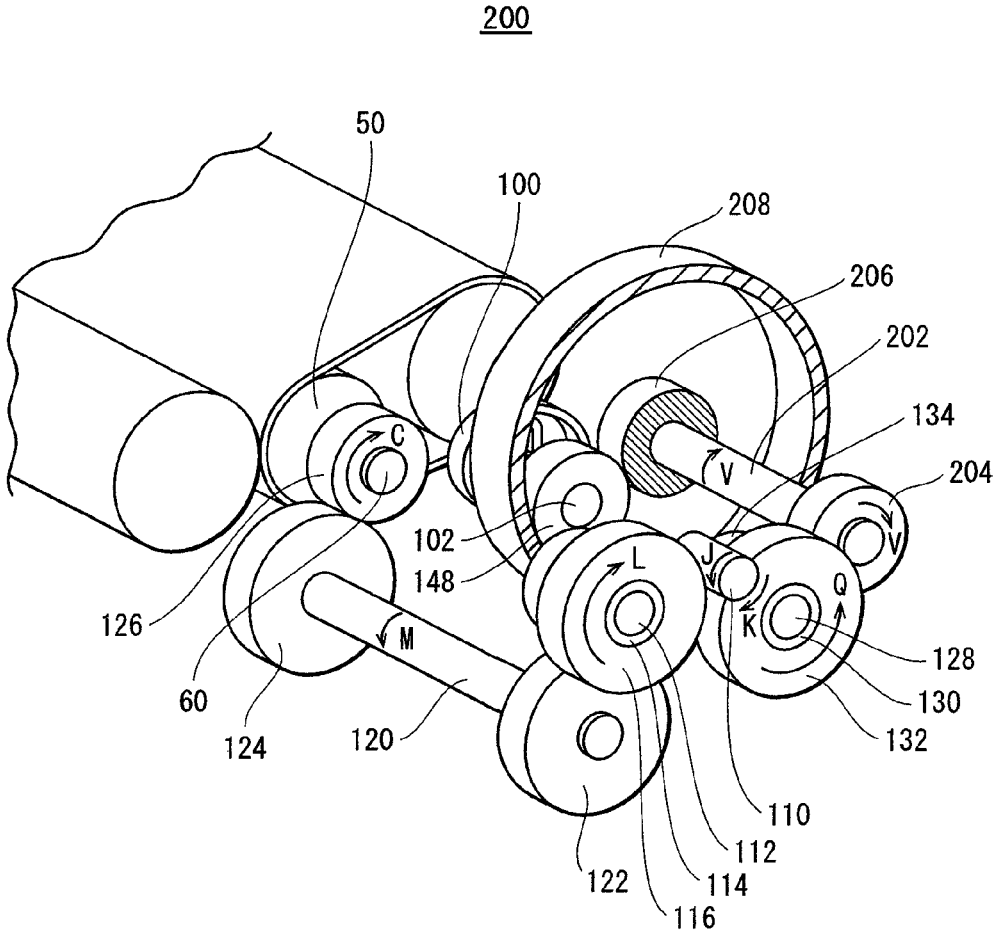
FIG. 8 is a perspective view of the fixing device according to Embodiment 2, illustrating a portion of the structure of a mechanism for transmitting power from a motor to a fixing roller and a plate cam.
Figure 9:
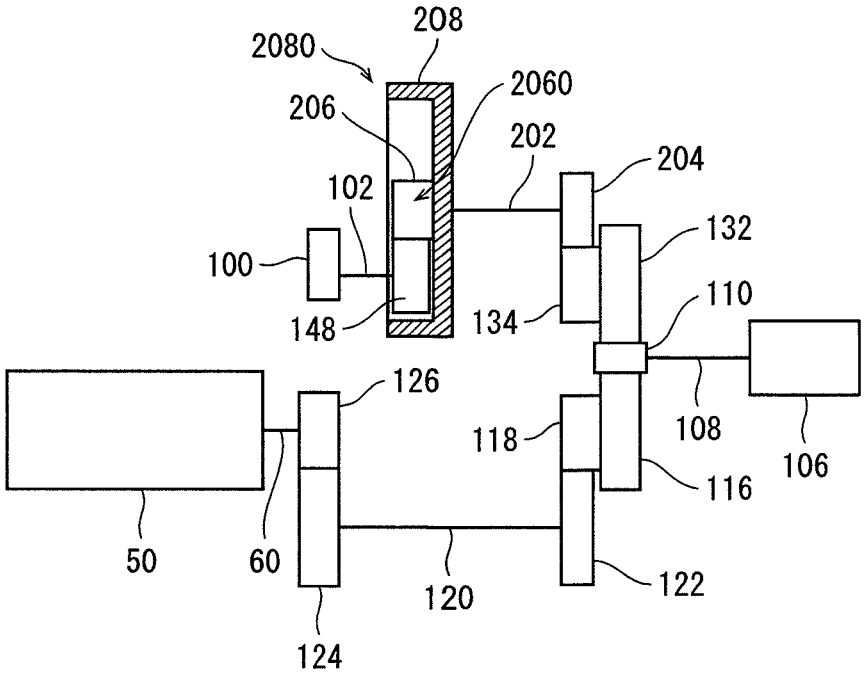
FIG. 9 illustrates power transmission paths in the power transmission mechanism.

FIG. 8 is a perspective view of a fixing device 200 in Embodiment 2, showing the structure of a mechanism for transmitting power from the motor 106 (not shown in FIG. 8; see FIG. 9) to the fixing roller 50, as well as the structure of a mechanism for transmitting power from the motor 106 to the plate cam 100 (cam shaft 102). FIG. 9 shows the power transmission path in each of the power transmission mechanisms. FIGS. 8 and 9 are drawn similarly to FIGS. 4 and 5 respectively.

First, the mechanism for transmitting power from the motor 106 to the fixing roller 50 is substantially similar to Embodiment 1. Therefore, corresponding components are labeled with the same numbers as in Embodiment 1, and a description thereof is omitted.

Next, the mechanism for transmitting power from the motor 106 to the plate cam 100 is described.

This mechanism for transmitting power is also substantially similar to Embodiment 1 from the spur gear 110 to the spur gear 134. Therefore, corresponding components are labeled with the same numbers as in Embodiment 1, and a description thereof is omitted.

A shaft 202 is provided parallel to the central axis of the output shaft 108. A spur gear 204 is attached to one end of the shaft 202. The spur gear 204 is engaged with the spur gear 134.

A second partially toothed gear 208 is attached to the other end of the shaft 202. The second partially toothed gear 208 is an internal gear in the shape of a shallow cup. A first partially toothed gear 206 is attached to the section of the shaft 202 located within the second partially toothed gear 208. In other words, the first partially toothed gear 206 and the second partially toothed gear 208 are attached along the same axis (shaft 202).

Figure 10:
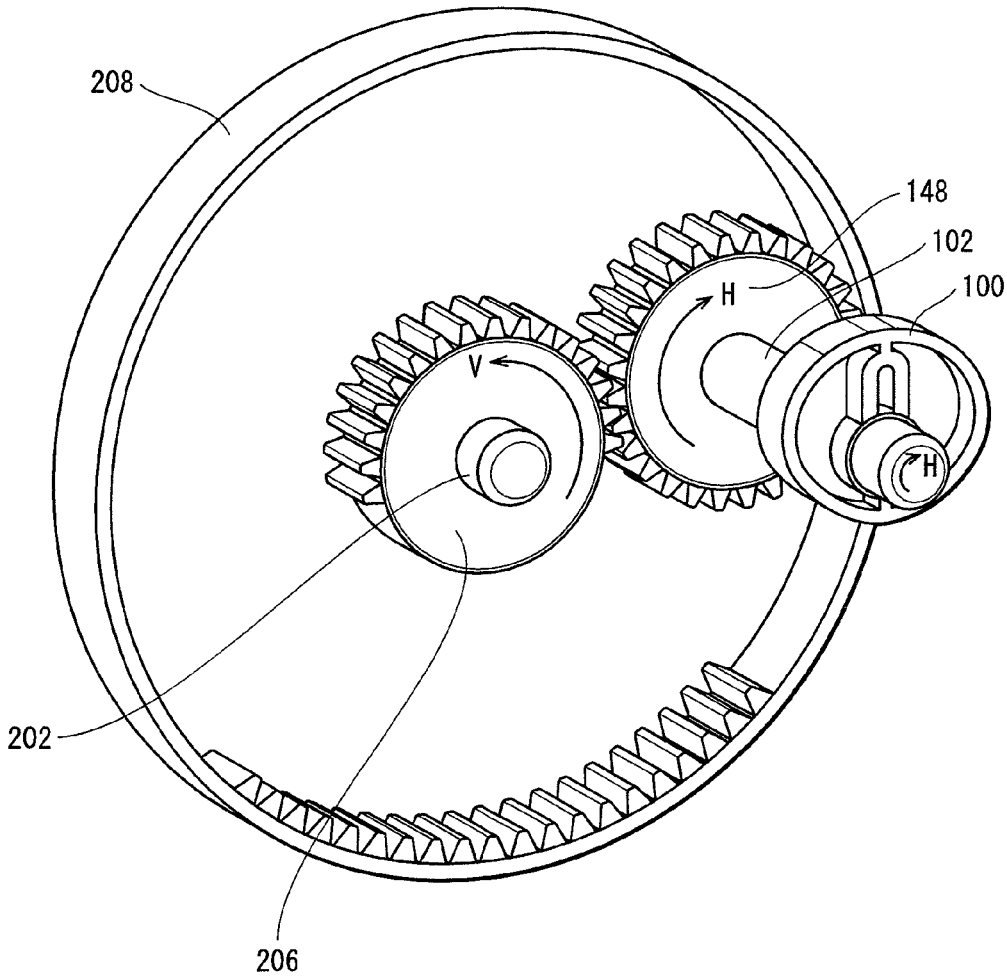
FIG. 10 is a perspective view of a portion of the power transmission mechanism.

FIG. 8 illustrates the cup-shaped second partially toothed gear 208 with the bottom portion thereof cut away. FIG. 10 is a perspective view from the opening side of the second partially toothed gear 208 (i.e. as seen from the opposite side than in FIG. 8).

The first partially toothed gear 206 is a partially toothed spur gear having a section in which no teeth are formed along a certain length in the circumferential direction of the gear. The first partially toothed gear 206 is provided with enough teeth so that one rotation of the first partially toothed gear 206 causes the spur gear 148 attached to the cam shaft 102 to undergo at least one-half of a rotation. The teeth of the first partially toothed gear 206 are provided in a range that allows for rotation of the plate cam 100 from lower dead center to upper dead center.

The second partially toothed gear 202 is a partially toothed spur gear having a section in which no teeth are formed along a certain length in the circumferential direction of the gear. The second partially toothed gear 208 is provided with enough teeth so that one rotation of the second partially toothed gear 208 causes the spur gear 148 attached to the cam shaft 102 to undergo at least one-half of a rotation. Furthermore, the teeth of the second partially toothed gear 208 are provided in a range such that the spur gear 148 does not also engage simultaneously with the first partially toothed gear 206.

Returning to FIGS. 8 and 9, when the motor 106 (FIG. 9) rotates in the reverse direction and the spur gear 110 rotates in the direction of the arrow K, the spur gear 132 engaged with the spur gear 110 rotates in the direction of the arrow Q.

Due to the action of the one-way clutch 130, the rotational power of the spur gear 132 is transmitted to the shaft 128, and the spur gear 134 attached to the shaft 128 also rotates in the direction of the arrow Q.

The spur gear 204, which is engaged with the spur gear 134, rotates in the direction of the arrow V, and the shaft 202 to which the spur gear 204 is attached therefore also rotates in the direction of the arrow V.

Returning to FIG. 10, when the shaft 202 rotates in the direction of the arrow V, the first partially toothed gear 206 and the second partially toothed gear 208 attached thereto also rotate in the direction of the arrow V.

While the spur gear 148 attached to the cam shaft 102 is engaged with the first partially toothed gear 206, the plate cam 100 rotates in the direction of the arrow H from lower dead center to upper dead center. Conversely, while the spur gear 148 is engaged with the second partially toothed gear 208, the plate cam 100 rotates in the direction opposite the arrow H from upper dead center to lower dead center.

As described above, the mechanism for transmitting power from the output shaft 108 of the motor 106 to the cam shaft 102 splits partway through into two power transmission paths.

In the mechanism for transmitting power from the output shaft 108 of the motor 106 to the cam shaft 102, a path in which power is transmitted via the first partially toothed gear 206 is referred to as a first power transmission path 2060, and a path in which power is transmitted via the second partially toothed gear 208 is referred to as a second power transmission path 2080.

In the above case, the reduction ratio from the spur gear 110, attached to the output shaft 108 of the motor 106, to the spur gear 148, attached to the cam shaft 102, is smaller in the second power transmission path 2080 than in the first power transmission path 2060, due to a difference in diameter between the first partially toothed gear 206 and the second partially toothed gear 208.

Therefore, the plate cam 100 rotates faster when rotated via the second power transmission path 2080 than when rotated via the first power transmission path 2060. Conversely, the first power transmission path 2060 allows for rotation of the plate cam 100 with a greater toque than the second power transmission path 2080.

In the mechanism for transmitting power from the output shaft 108 of the motor 106 to the cam shaft 102, let (i) the reduction ratio in the case of the first power transmission path 2060 be Rb1 and the reduction ratio in the case of the second power transmission path 2080 be Rb2, (ii) the rotation speed of the plate cam 100 in the case of the first power transmission path 2060 be Sb1 and the rotation speed of the plate cam 100 in the case of the second power transmission path 2080 be Sb2, assuming the same speed of revolution of the motor 106, and (iii) the torque acting on the cam shaft 102 in the case of the first power transmission path 2060 be Tb1 and the torque acting on the cam shaft 102 in the case of the second power transmission path 2080 be Tb2. The magnitudes of these values compare as follows.

$$Rb1>Rb2,\ Sb1<Sb2,\ Tb1>Tb2$$

In Embodiment 2, when the pressing roller 56 is caused to press against the fixing roller 50, i.e. when the plate cam 100 is rotated from upper dead center in FIG. 3 to lower dead center in FIG. 2, the second power transmission path 2080 is used. This is because in this case, as in Embodiment 1, it is necessary to rotate the plate cam 100 quickly in order to complete the pressing operation and begin image formation of the first sheet rapidly. At the same time, since the compression spring 84 tends to extend, the swing plate 70 hardly bears the load (torque) for rotating the plate cam 100.

Conversely, when the pressing roller 56 is caused to separate from the fixing belt 54, i.e. when the plate cam 100 is rotated from lower dead center in FIG. 2 to upper dead center in FIG. 3, the first power transmission path 2060 is used. This is because in this case, as in Embodiment 1, a large torque is necessary to rotate the swing plate 70 against the elastic force of the compression spring 84. At the same time, since the separating operation is performed after a series of image formation operations, it poses no problem for the separating operation to require a relatively longer time.

The CPU 44 (FIG. 1) of the controller 42 performs rotation control of the plate cam 100 and normal/reverse rotation control of the motor 106.

While omitted from the figures, the CPU 44 is connected to the motor driver 156 that controls the reverse/normal rotation of the motor 106 (FIG. 5), to the lower dead center sensor 162, and to the upper dead center sensor 164, as in Embodiment 1 (FIG. 6).

Figure 7:
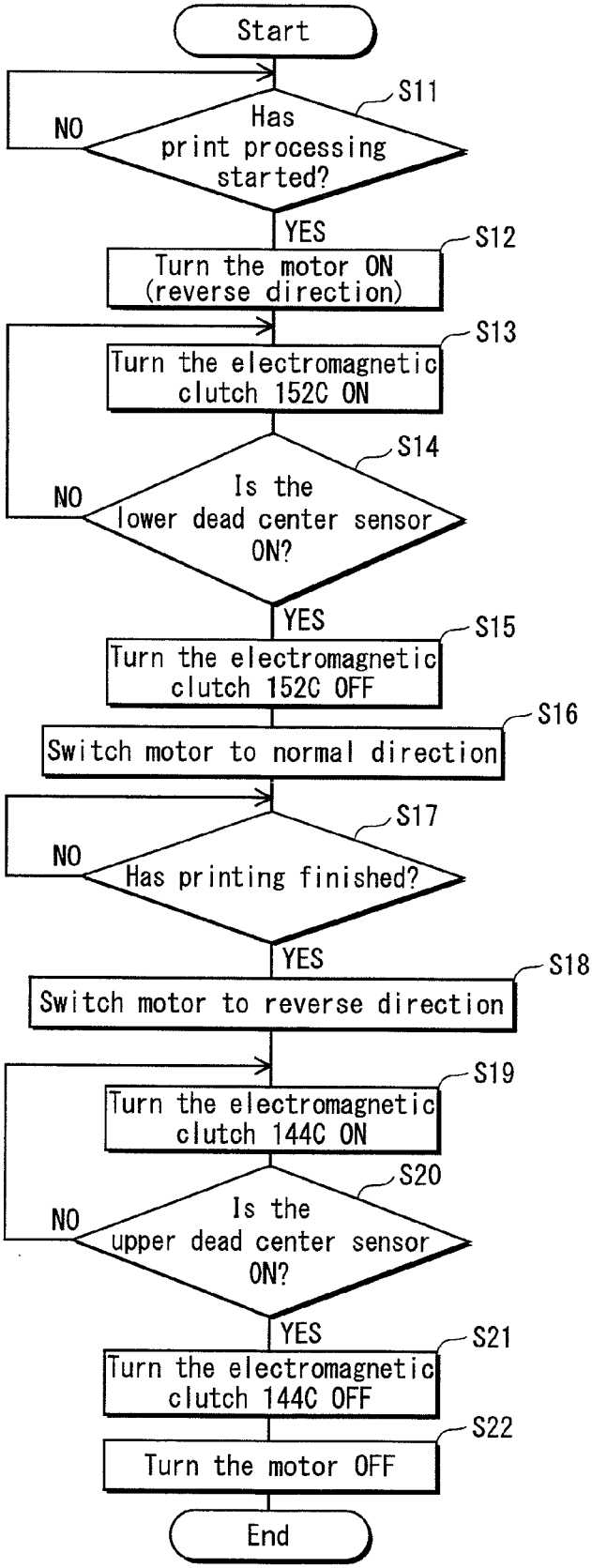
FIG. 7 is a flowchart of a control program executed by the controller of the fixing device according to Embodiment 1.

The program that the CPU 44 executes to control the motor is basically the same as in the flowchart in FIG. 7 of Embodiment 1, with the omission of processing for control to engage and disengage the electromagnetic clutch (steps S13, S15, S19, and S21). A description of the program is thereof omitted here.

With the above structure, the fixing device 200 of Embodiment 2 achieves both rotation of the fixing belt 54 and pressing/separation of the pressing roller 56 and the fixing belt 54 with a single motor 106. Moreover, while pressing the pressing roller 56 against the fixing belt 54, the plate cam 100 is rotated via the second power transmission path 2080, which has a lower reduction ratio, thereby shortening the time until completion of the pressing operation. Conversely, when separating the pressing roller 56 from the fixing belt 54, the plate cam 100 is rotated via the first power transmission path 2060, which has a higher reduction ratio, in order to achieve the torque necessary to compress the compression spring 84 (i.e. to store elastic energy). This selective use of power transmission paths prevents the motor from becoming unnecessarily large.

As can be understood from the description thus far, in the fixing device with the above structure, when the pressing member and the heating rotating body are switched from the first state, in which the pressing member receives the biasing force of the biasing unit and presses against the heating rotating body, to the second state, in which the pressing member and the heating rotating body are separated in resistance to the biasing force of the biasing unit, the rotational power of the motor is transmitted to the switching unit over the first transmission path, whereas when the pressing member and the heating rotating body are switched from the second state to the first state, the rotational power of the motor is transmitted to the switching unit over the second transmission path. Setting the reduction ratio of the first transmission path to be larger than the reduction ratio of the second transmission path allows for rapid switching of the pressing member and the heating rotating body to the first state, thereby shortening the time required to switch the direction of rotation of the motor and start rotation of the heating rotating body. Setting the reduction ratio in this way also allows for a decrease in the load torque on the motor when switching the pressing member and the heating rotating body to the second state, thereby reducing an increase in motor size insofar as possible.

The present invention has been described based on embodiments thereof, but the present invention is of course in no way limited to the above embodiments. For example, the following modifications are possible.

(1) In the above embodiments, an example is described of adopting the present invention in a fixing device that uses the thermal belt fixing method, namely a fixing device that includes a heat roller with an internal heat source, a fixing roller, a fixing belt stretched between the fixing roller and the heat roller to serve as a heating rotating body, and a pressing roller that presses against the fixing roller with the fixing belt therebetween in order to form a fixing nip. The present invention is not, however, limited in this way, and may for example be adopted in fixing devices that use a heat roller fixing method. A fixing device that uses the heat roller fixing method forms a fixing nip by directly pressing a pressing roller, which is a pressing member, against a fixing roller (heating rotating body) with an internal heat source.

(2) In the above embodiments, a pressing roller is used as a pressing member, but the pressing member is not limited in this way. Alternatively, a pressing pad may be used.

(3) In the above embodiments, the pressing member (pressing roller) is moved (displaced) to change the position of the pressing member relative to the heating rotating body (fixing belt), but the present invention is not limited in this way. Alternatively, the heating rotating body may be displaced in order to change the position of the pressing member relative to the heating rotating body.

(4) In the above embodiments, a compression coil spring is used as the biasing unit, but the biasing unit is not limited to a compression coil spring. Alternatively, a different elastic member such as a leaf spring or a sponge may be used. Furthermore, use is not limited to a compression spring, and an extension spring may instead be used.

(5) In the above embodiments, a mechanism including a cam, which is an eccentric member, is used as the switching unit, but the switching unit is not limited to such a mechanism. Instead, another well-known mechanism may be used. In other words, any mechanism that converts the rotational movement from the motor into swinging movement of the swing plate, which is a support member of the pressing roller, may be used. For example, such a mechanism may include a crank and a swing lever. In this case, the swing lever itself may serve as the swing plate. Alternatively, a mechanism that converts rotational movement from the motor into linear movement and causes the support member of the pressing roller to reciprocate linearly with respect to the fixing belt (fixing roller) may be used. For example, a slider-crank mechanism may be adopted.

(6) In the above embodiments, the fixing roller rotates when the motor rotates in the normal direction, and the plate cam rotates when the motor rotates in the reverse direction. Alternatively, the opposite configuration may be adopted, so that rotation of the motor in the reverse direction causes the fixing roller to rotate, and rotation of the motor in the normal direction causes the plate cam to rotate.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device comprising:

a heating rotating body driven by a motor;

a pressing member;

a biasing unit configured to place the pressing member and the heating rotating body in a first state by pressing the pressing member and the heating rotating body together with a biasing force so as to form a nip through which a recording sheet with a toner image formed thereon passes;

a switching unit configured to receive rotational power of the motor in order to switch the pressing member and the heating rotating body from the first state to a second state, in which the pressing member and the heating rotating body are not in contact, by separating the pressing member and the heating rotating body from each other in resistance to the biasing force of the biasing unit, and to switch the pressing member and the heating rotating body from the second state to the first state by allowing the biasing force of the biasing unit to press the pressing member and the heating rotating body together;

a power transmission mechanism configured to transmit the rotational power of the motor to the switching unit; and a power transmission targeting unit configured to switch a target of the transmission of the rotational power of the motor between the heating rotating body and the switching unit in accordance with whether the motor rotates in a normal direction or a reverse direction, wherein the power transmission mechanism uses one of a first transmission path and a second transmission path for the transmission of rotational power, a reduction ratio of the first transmission path being larger than a reduction ratio of the second transmission path, and the power transmission targeting unit includes a path selection unit configured to select the first transmission path when the switching unit switches the pressing member and the heating rotating body from the first state to the second state and to select the second transmission path when the switching unit switches the pressing member and the heating rotating body from the second state to the first state.

2. The fixing device of claim 1, wherein the power transmission mechanism includes:

a first external gear and a second external gear attached along a same axis, a diameter of the second external gear being larger than a diameter of the first external gear;

a third gear that engages with the first external gear and transmits power downstream; and a fourth gear that engages with the second external gear and transmits power downstream, the first external gear and the third external gear form a portion of the first transmission path, the second external gear and the fourth external gear form a portion of the second transmission path, and the reduction ratio of the first transmission path is larger than the reduction ratio of the second transmission path due to the diameter of the second external gear being larger than the diameter of the first external gear, and the path selection unit is constituted by a clutch provided within the first transmission path and a clutch provided within the second transmission path.

3. The fixing device of claim 1, wherein the switching unit includes an eccentric member attached to a shaft of the power transmission mechanism and switches the pressing member and the heating rotating body between the first state and the second state in accordance with an eccentricity of the eccentric member, the power transmission mechanism includes:

a first external gear;

an internal gear provided along a same axis as the first external gear and surrounding the first external gear; and a second external gear provided between the first external gear and the internal gear and interlocking with the eccentric member, the first external gear and the internal gear are partially toothed gears each having no teeth in a predetermined angular range, and the second external gear engages with only one of the first external gear and the internal gear in correspondence with a rotational angle of the eccentric member, the first transmission path being formed by the second external gear engaging only with the first external gear and the second transmission path being formed by the second external gear engaging only with the internal gear.

4. An image forming apparatus that forms an image on a recording sheet by electrophotography and includes a fixing device that fixes a toner image to a recording sheet on which the toner image is formed, the fixing device comprising:

a heating rotating body driven by a motor;

a pressing member;

a biasing unit configured to place the pressing member and the heating rotating body in a first state by pressing the pressing member and the heating rotating body together with a biasing force so as to form a nip through which a recording sheet with a toner image formed thereon passes;

a switching unit configured to receive rotational power of the motor in order to switch the pressing member and the heating rotating body from the first state to a second state, in which the pressing member and the heating rotating body are not in contact, by separating the pressing member and the heating rotating body from each other in resistance to the biasing force of the biasing unit, and to switch the pressing member and the heating rotating body from the second state to the first state by allowing the biasing force of the biasing unit to press the pressing member and the heating rotating body together;

a power transmission mechanism configured to transmit the rotational power of the motor to the switching unit; and a power transmission targeting unit configured to switch a target of the transmission of the rotational power of the motor between the heating rotating body and the switching unit in accordance with whether the motor rotates in a normal direction or a reverse direction, wherein the power transmission mechanism uses one of a first transmission path and a second transmission path for the transmission of rotational power, a reduction ratio of the first transmission path being larger than a reduction ratio of the second transmission path, and the power transmission targeting unit includes a path selection unit configured to select the first transmission path when the switching unit switches the pressing member and the heating rotating body from the first state to the second state and to select the second transmission path when the switching unit switches the pressing member and the heating rotating body from the second state to the first state.

5. The image forming apparatus of claim 4, wherein the power transmission mechanism includes:

a first external gear and a second external gear attached along a same axis, a diameter of the second external gear being larger than a diameter of the first external gear;

a third gear that engages with the first external gear and transmits power downstream; and a fourth gear that engages with the second external gear and transmits power downstream, the first external gear and the third external gear form a portion of the first transmission path, the second external gear and the fourth external gear faun a portion of the second transmission path, and the reduction ratio of the first transmission path is larger than the reduction ratio of the second transmission path due to the diameter of the second external gear being larger than the diameter of the first external gear, and the path selection unit is constituted by a clutch provided within the first transmission path and a clutch provided within the second transmission path.

6. The image forming apparatus of claim 4, wherein the switching unit includes an eccentric member attached to a shaft of the power transmission mechanism and switches the pressing member and the heating rotating body between the first state and the second state in accordance with an eccentricity of the eccentric member, the power transmission mechanism includes:

a first external gear;

an internal gear provided along a same axis as the first external gear and surrounding the first external gear; and a second external gear provided between the first external gear and the internal gear and interlocking with the eccentric member, the first external gear and the internal gear are partially toothed gears each having no teeth in a predetermined angular range, and the second external gear engages with only one of the first external gear and the internal gear in correspondence with a rotational angle of the eccentric member, the first transmission path being formed by the second external gear engaging only with the first external gear and the second transmission path being formed by the second external gear engaging only with the internal gear.

* * * * *